US009210772B2

(12) United States Patent
Maiwald

(10) Patent No.: US 9,210,772 B2
(45) Date of Patent: Dec. 8, 2015

(54) ACTUATING A PLURALITY OF SERIES-CONNECTED LUMINOUS ELEMENTS

(75) Inventor: Hubert Maiwald, Neutraubling (DE)

(73) Assignee: OSRAM GmbH, Munich (DE)

( * ) Notice: Subject to any disclaimer, the term of this patent is extended or adjusted under 35 U.S.C. 154(b) by 306 days.

(21) Appl. No.: 13/985,033

(22) PCT Filed: Jan. 26, 2012

(86) PCT No.: PCT/EP2012/051183

§ 371 (c)(1),
(2), (4) Date: Aug. 12, 2013

(87) PCT Pub. No.: WO2012/107293

PCT Pub. Date: Aug. 16, 2012

(65) Prior Publication Data

US 2013/0313984 A1 Nov. 28, 2013

(30) Foreign Application Priority Data

Feb. 10, 2011 (DE) ..... 10 2011 003 931

(51) Int. Cl.
*H05B 37/00* (2006.01)
*H05B 37/02* (2006.01)
*H05B 33/08* (2006.01)

(52) U.S. Cl.
CPC ..... *H05B 37/02* (2013.01); *H05B 33/083* (2013.01); *H05B 33/0824* (2013.01)

(58) Field of Classification Search
CPC ..... H05B 37/00
See application file for complete search history.

(56) References Cited

U.S. PATENT DOCUMENTS

| | | | | |
|---|---|---|---|---|
| 8,410,717 | B2 * | 4/2013 | Shteynberg et al. | 315/291 |
| 2010/0181923 | A1 | 7/2010 | Hoogzaad | |
| 2010/0308738 | A1 | 12/2010 | Shteynberg et al. | |
| 2010/0308739 | A1 | 12/2010 | Shteynberg et al. | |

FOREIGN PATENT DOCUMENTS

| | | |
|---|---|---|
| EP | 2 187 706 | 5/2010 |
| TW | 201019795 | 5/2010 |
| WO | WO 2010/013172 | 2/2010 |
| WO | WO 2010/148113 | 12/2010 |

* cited by examiner

*Primary Examiner* — Hai L Nguyen
(74) *Attorney, Agent, or Firm* — Cozen O'Connor

(57) ABSTRACT

A circuit for actuating a plurality of light-emitting means which are connected in series, comprising a plurality of electronic switches, which can be actuated depending on a rectified system voltage. The plurality of electronic switches are arranged in parallel with at least some of the light-emitting means, wherein each of the plurality of electronic switches short-circuits on activation of at least one of the light-emitting means connected in series. At least one energy store is connected in parallel with a first group of light-emitting means during a charge phase by virtue of the electronic switches, and it is connected in parallel with a second group of light-emitting means during a discharge phase by virtue of the electronic switches.

17 Claims, 3 Drawing Sheets

ACTUATING A PLURALITY OF SERIES-CONNECTED LUMINOUS ELEMENTS

RELATED APPLICATIONS

This is a U.S. national stage of International application No. PCT/EP2012/051183 filed on Jan. 26, 2012.

This application claims the priority of German application no. 10 2011 003 931.7 filed Feb. 10, 2011, the entire content of which are hereby incorporated by reference.

FIELD OF THE INVENTION

The invention relates to a circuit for actuating a plurality of light-emitting means connected in series.

BACKGROUND OF THE INVENTION

In principle, it is a problem to operate semiconductor light-emitting elements, for example light-emitting diodes (LEDs) or LED systems, directly on an electrical power supply system, in particular when the semiconductor light-emitting elements are intended to be dimmable and to have at least approximately a sinusoidal current consumption.

Known approaches use step-up or step-down converters for adjusting a supply voltage for the semiconductor light-emitting elements. A filter capacitor is also used after the system rectification in order to keep the current in the semiconductor light-emitting elements at a virtually constant level. Such solutions are not dimmable. Furthermore, the current profile through the semiconductor light-emitting elements is not sinusoidal, which results in disadvantageous loading or undesirable interference on the AC system.

A further disadvantage consists in that a circuit without an energy store (filter capacitor) results in visible flicker in the connected light-emitting means. However, the filter capacitor also has the disadvantage that high charge-reversal currents reduce its life; therefore, the filter capacitor is often the weakest link in a circuit for actuating the light-emitting means.

SUMMARY OF THE INVENTION

One object of the invention is to avoid the abovementioned disadvantages and, in particular, to provide a solution for operating semiconductor light-emitting elements efficiently and dimmably over a system voltage.

This and other objects are attained in accordance with one aspect of the invention directed to a circuit or a circuit arrangement for actuating a plurality of light-emitting means which are connected in series,

- comprising a plurality of electronic switches, which can be actuated depending on a rectified system voltage,
- wherein the plurality of electronic switches are arranged in parallel with at least some of the light-emitting means,
- wherein each of the plurality of electronic switches short-circuits on activation of in each case at least one of the light-emitting means connected in series,
- with at least one energy store,
  - which is connected in parallel with a first group of light-emitting means during a charge phase by virtue of the electronic switches, and
  - which is connected in parallel with a second group of light-emitting means during a discharge phase by virtue of the electronic switches.

Thus, the energy store can advantageously act as charge pump and, independently of the level of the rectified system voltage,

- provide electrical energy for some of the light-emitting means when a predetermined threshold value is undershot, and
- be charged via the rectified system voltage when the predetermined threshold value (or a further threshold value) is exceeded.

This means that, over the course of a cycle (comprising for example discharging, charging and discharging of the energy store), at least some of the light-emitting means can emit light virtually without interruption. The interruptions are not present or are so short that flicker in the light-emitting means cannot be perceived by the human eye. Owing to the energy store operating as charge pump, noticeable flicker in the light-emitting means is thus effectively suppressed.

It is noted here that the discharge phase comprises in particular only partial discharge of the energy store (complete discharge is not necessary and sometimes also undesirable). Therefore, the charge phase takes into account the fact that electrical energy is supplied to the energy store and the discharge phase takes into account the fact that electrical energy is withdrawn from the energy store.

A development consists in that there is a higher voltage drop across the first group of light-emitting means than across the second group of light-emitting means.

Therefore, safe and advantageous charging of the energy store can be achieved.

Another development consists in that the energy store can be charged during an initial charge phase over a plurality of cycles of the rectified system voltage.

If the energy store, for example a capacitor, is initially (virtually) empty, it is charged over a plurality of cycles. Then, the cyclic operation about a working point takes place as described above.

It is noted here that a cycle can correspond to a positive half-wave of the rectified pulsating system voltage. The frequency of the half-waves (and therefore of the cycles) corresponds in particular to twice the frequency of the AC system voltage.

In particular, a development consists in that the energy store is connected in series with a current source, in particular a constant current source or a voltage-controlled current source.

It is thus possible to ensure that the energy store provides a suitable current during the discharge phase of the second group of light-emitting means.

A further development consists in that the light-emitting means connected in series are connected in series with a voltage-controlled current source.

By virtue of the voltage-controlled current source, the current through the light-emitting means is adjusted or limited (depending on the number of light-emitting means activated by means of the electronic switches). Furthermore, the charge current of the energy store can be limited by the voltage-controlled current source if the voltage-controlled current source is arranged, for example, in series with the parallel circuit comprising the energy store and the light-emitting means.

An additional development consists in that the voltage-controlled current source is actuable via the rectified system voltage.

By virtue of the actuation of the voltage-controlled current source by means of the, for example, near-sinusoidal pulsating rectified system voltage, a correspondingly matched lower current flows also through the light-emitting means at low voltage values (at which only one light-emitting means or few light-emitting means are activated) than at high voltage values (at which, for example, all of the light-emitting means are activated). Thus, the voltage-controlled current source provides a current suitable for the number of light-emitting means active at that time.

Both the number of active light-emitting means and the current through these light-emitting means is therefore influenced or adjusted by the waveform of the rectified system voltage. This advantageously results in a virtually sinusoidal current consumption and thus minimizes interference which acts on the power supply system originating from the circuit.

In the context of an additional development, the electronic switches and the voltage-controlled current source are arranged together in an integrated circuit.

A further development consists in that a first energy store and a second energy store are provided, wherein the first energy store

- is connected in parallel with the first group of light-emitting means during a charge phase by virtue of the electronic switches, and
- is connected in parallel with the second group of light-emitting means during a discharge phase by virtue of the electronic switches, wherein the second energy store

- is connected in parallel with the first group of light-emitting means during a charge phase by virtue of the electronic switches, and
- is connected in parallel with a third group of light-emitting means during a discharge phase (for example using the electronic switches), wherein the third group of light-emitting means is, for example, a subset of the first group of light-emitting means.

It is thus possible to additionally reduce flicker by virtue of providing a further charge pump. In particular, the two energy stores can be activated alternately during the discharge phase (for example when the rectified system voltage reaches or falls below a predetermined threshold value). This can take place by virtue of corresponding actuation of electronic switches which are arranged, for example, in series with the respective energy store.

One configuration consists in that detection and evaluation of the rectified system voltage is performed using a control unit and, depending on a level of the detected system voltage, more or fewer light-emitting means can be activated via the electronic switches.

In particular, different electronic switches are actuated depending on the level of the rectified system voltage. Thus, different electronic switches can be activated stepwise via the rectified system voltage and therefore a different number of light-emitting means connected in series can be activated or deactivated. The profile of a pulsating DC voltage can thus be used to activate or deactivate different numbers of the light-emitting means depending on the voltage value of said DC voltage.

The electronic switches are arranged in parallel with the light-emitting means. In particular, each electronic switch can bridge (or short-circuit) a different number of light-emitting means when activated. It is advantageous if the electronic switches are arranged in such a way that one of the light-emitting means can be bridged on activation of a first electronic switch, two of the light-emitting means can be bridged on activation of a second electronic switch, three of the light-emitting means can be bridged on activation of a third electronic switch, etc. On activation of the last electronic switch, for example, all but one of the light-emitting means connected in series are bridged.

A common reference potential for the electronic switches ensures, for example, that each of the electronic switches is activatable with the same switching voltage.

An alternative embodiment consists in that, in particular, dimmable actuation of the light-emitting means is performed using the control unit.

Thus, for example, brightness regulation (dimming) of the light-emitting means connected in series can take place by means of a reference voltage which can be variable by a user.

A further configuration consists in that the control unit and the electronic switches are integrated together in a circuit.

A development consists in that the light-emitting means comprises at least one semiconductor light-emitting element, in particular a group of semiconductor light-emitting elements.

The semiconductor light-emitting element can be a light-emitting diode (LED).

A configuration consists in that the electronic switches comprise semiconductor switches, in particular transistors, bipolar transistors and/or MOSFETs.

Another configuration consists in that the energy store comprises a capacitor, an electrolyte capacitor or a battery.

The battery can be a rechargeable battery.

BRIEF DESCRIPTION OF THE DRAWINGS

Exemplary embodiments of the invention will be illustrated and explained below using the drawings.

DETAILED DESCRIPTION OF THE DRAWINGS

The invention proposes using one or more charge pumps for operating light-emitting means, wherein the at least one charge pump is charged, for example, (substantially or preferably) continuously at the beginning and then cyclically (or iteratively). In time periods in which a value of the system voltage is low, the energy is made available to the light-emitting means (in particular a chain or a series circuit of semiconductor light-emitting elements, for example light-emitting diodes) without the current consumption from the electrical system being substantially distorted or disrupted in the process.

The light-emitting means can be operated via a voltage-controlled current source, wherein a pulsating rectified system voltage can act as controlling voltage, for example. The (near-sinusoidal) half-waves of the rectified (pulsating) system voltage have twice the frequency of the AC system voltage (i.e. 100 Hz or 120 Hz, for example). This also results in a (virtually or substantially) sinusoidal operating current for the operation of the light-emitting means.

The light-emitting means can be actuated via electronic switches. The electronic switches may be semiconductor switches, for example transistors, bipolar transistors, MOSFETs, etc. Preferably, semiconductor switches with a common reference potential can be used. As a result, the actuation of the semiconductor switches is simplified. In addition, the semiconductor switches can be integrated together with the unit actuating them (for example on silicon).

Figure 1:
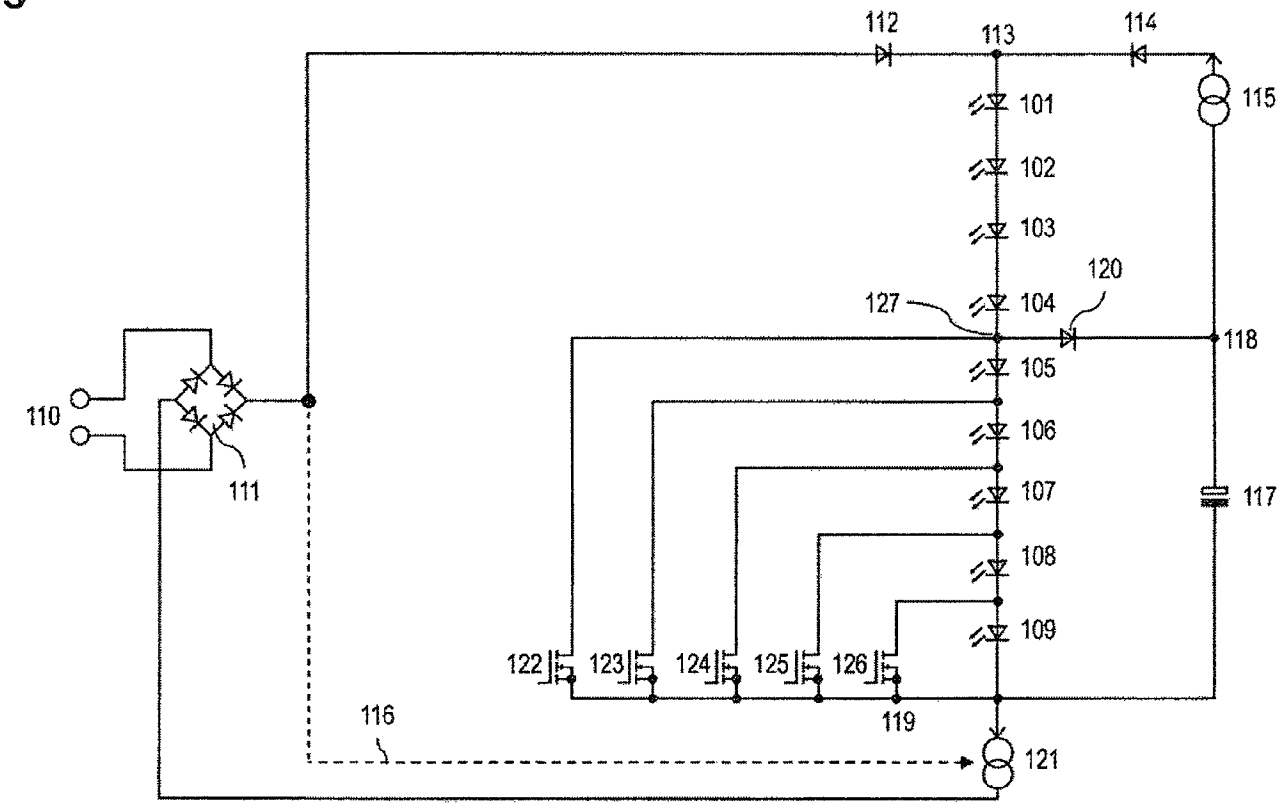
FIG. 1 shows a schematic circuit diagram with a charge pump for operating a plurality of light-emitting diodes connected in series on an AC system voltage.

FIG. 1 shows a schematic circuit diagram for the operation of a plurality of light-emitting diodes 101 to 109 connected in series on an AC system voltage 110.

The AC system voltage 110 is converted into a (pulsating) DC voltage via a rectifier 111. The DC voltage is connected to the anode of a diode 112 (positive supply voltage) and to the connection of a current source 121 (ground potential) downstream of the rectifier 110.

The cathode of the diode 112 is connected to a node 113. The node 113 is connected to a node 118 via a series circuit comprising a diode 114 and an (optional) current source 115, wherein the cathode of the diode 114 points in the direction of the node 113.

The light-emitting diodes 101 to 109 are connected in series in the same orientation, wherein the anode of the light-emitting diode 101 is connected to the node 113, and the cathode of the light-emitting diode 109 is connected to a node 119. The current source 121 is arranged between this node 119 and the rectifier 111.

A tap or center tap between the light-emitting diodes 104 and 105 is referred to as a node 127. A diode 120 is arranged between the node 127 and the node 118, the cathode of said diode pointing in the direction of the node 118. A capacitor 117 (for example in the form of an electrolyte capacitor) is arranged between the node 117 and the node 119.

The node 127 is also connected to the drain connection of a MOSFET 122. The source connection of the MOSFET 122 is connected to the node 119. A tap between the light-emitting diodes 105 and 106 is connected to the drain connection of a MOSFET 123. The source connection of the MOSFET 123 is connected to the node 119. A tap between the light-emitting diodes 106 and 107 is connected to the drain connection of a MOSFET 124. The source connection of the MOSFET 124 is connected to the node 119. A tap between the light-emitting diodes 107 and 108 is connected to the drain connection of a MOSFET 125. The source connection of the MOSFET 125 is connected to the node 119. A tap between the light-emitting diodes 108 and 109 is connected to the drain connection of a MOSFET 126. The source connection of the MOSFET 126 is connected to the node 119.

The diodes 112, 114 and 120 can be diodes of the type 1N4004. Each light-emitting diode 101 to 109 can be in the form of at least one light-emitting diode or at least one semiconductor light-emitting element. In particular, each light-emitting diode 101 to 109 can comprise a group of light-emitting diodes. A setpoint voltage for a group of light-emitting diodes can in particular correspond to the total voltage through the number of light-emitting diodes per group.

For example, each light-emitting diode 101 to 109 can correspond to a group of light-emitting diodes which require a supply voltage of 35V.

Figure 3:
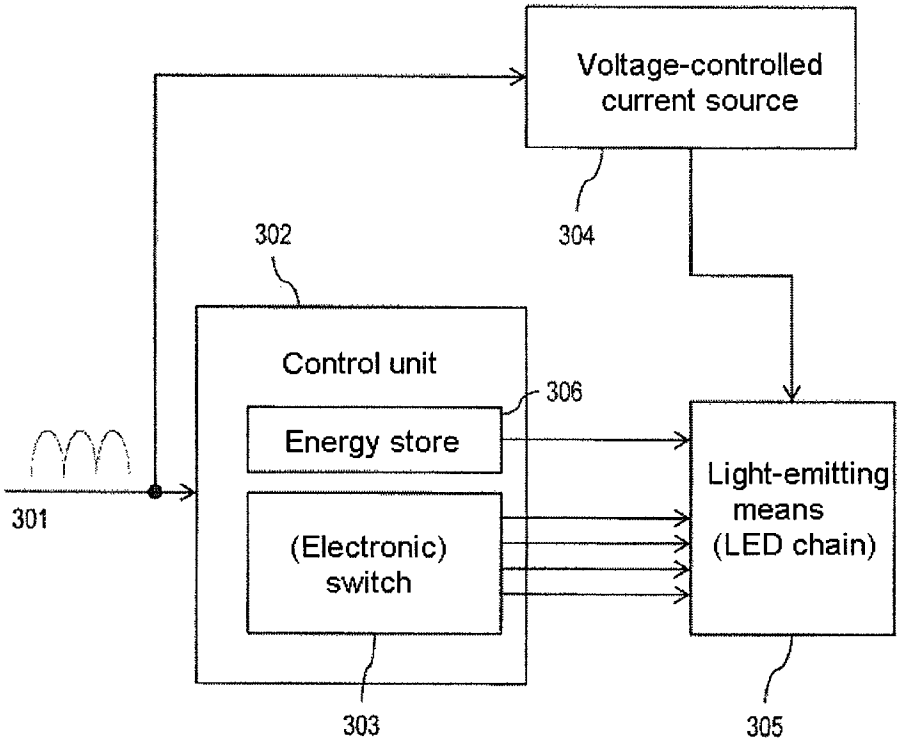
FIG. 3 shows a schematic circuit arrangement with a control unit for actuating electronic switches.

The gate connections of the MOSFETs 122 to 126 are actuated by a suitable control unit (not shown in FIG. 1; details relating to the control unit: see also FIG. 3).

Thus, the MOSFETs can be activated depending on the level of the system voltage, for example

- the MOSFET 126 at a system voltage of the order of 8*35V=280V;
- the MOSFET 125 at a system voltage of the order of 7*35V=245V;
- the MOSFET 124 at a system voltage of the order of 6*35V=210V;
- the MOSFET 123 at a system voltage of the order of 5*35V=175V;
- the MOSFET 122 at a system voltage of the order of 4*35V=140V.

If the respective MOSFET 122 to 126 is activated (short-circuited), preferably the remaining MOSFETs turn off. In the above example, this means that, in the case of a system voltage in a range of between approximately 175V and 210V, the MOSFET 123 is switched on, as a result of which the light-emitting diodes 106 to 109 are short-circuited or bridged. Thus, during this period, only the light-emitting diodes 101 to 105 are effectively connected in series and can be operated by the (present) system voltage. The same applies for the other switching states.

Instead of MOSFETs, any electronic switches can be used, for example (bipolar) transistors or the like. The electronic switches can be produced so as to be integrated together with the control unit and/or the current sources, for example on a silicon base.

It is noted that a center tap or tap illustrates the possibility of contact-making between two components. This corresponds electrically to a node, which can be connected to a plurality of components.

The capacitor 117 is first charged over a plurality of system periods to above a threshold voltage for the four light-emitting diodes 101 to 104 (in the above example: 140V). The charging takes place via the node 127 and the diode 120. The current source 121 also limits the charge current for the capacitor 117. During charging, the MOSFETs 122 to 126 are preferably turned off, i.e. none of the light-emitting diodes 105 to 109 is short-circuited.

The maximum charging of the capacitor 117 is in this case limited to approximately the value of the voltage drop across the five light-emitting diodes 105 to 109 (in the above example: 175V).

If the system voltage at the node 118 falls below a predetermined level (for example 165V in the above example), the energy stored in the capacitor 117 flows via the diode 114 and the node 113 into the series circuit of light-emitting diodes. In this case, the current flow is limited by the optionally provided current source 115. Preferably, in this case the MOSFET 122 is on, and the remaining MOSFETs 123 to 126 are off. Thus, the current flows from the node 113 via the light-emitting diodes 101 to 104 and the MOSFET 122 to the node 119 and from there on via the current source 121 in the direction of the rectifier 111.

The current source 121 limits the current flowing through the light-emitting diodes and the maximum charge current of the capacitor 117.

To this extent, the light-emitting diodes 101 to 109 can be operated cyclically at twice the frequency of the AC system voltage (the pulsating DC voltage which is provided by the rectifier 111 has twice the system frequency), wherein, in the case of a system voltage which is lower than a predetermined threshold value, the MOSFET 122 is switched on and the light-emitting diodes 101 to 104 are supplied with power by the capacitor 117. The capacitor is again recharged as long as the system voltage is greater than the predetermined threshold value (or greater than a second threshold value which is in turn greater than the mentioned threshold value); in this case, at least the MOSFET 122 is deactivated again (switched off).

Preferably, the circuit can be dimensioned in such a way that at least the light-emitting diodes 101 to 104 are not deenergized (or only for a very short period of time), irrespective of the instantaneous voltage value of the pulsating rectified waveform of the system voltage.

The first charging of the capacitor 117 can take place over a plurality of system cycles since the charge current is (also) limited by the current source 121.

Optionally, the current source 115 can be dispensed with. The current source 115 may be a constant current source or a voltage-controlled current source. In the latter case, the controlling voltage can be provided by the rectified system voltage.

Preferably, the energy which is supplied to the capacitor 117 during the charge cycle is above its cyclic discharge energy. Preferably, the charge voltage is greater than the discharge voltage of the capacitor. For example, the charge time can also be longer than the discharge time and/or a mean value for the charge current for the capacitor 117 can be greater than a mean value for its discharge current.

Therefore, the voltage at the capacitor 117 can fluctuate about an operating point after charging has taken place. In the example described here, this voltage can fluctuate between four times and five times the light-emitting diode voltage, i.e. between 140V and 175V. Advantageously, the capacitor 117 is designed in such a way that, in the application illustrated, the voltage level of 140V is not undershot during the discharge cycle.

For example, the recharging of the capacitor 117 takes place when the system voltage is so high that no MOSFET 122 to 126 at all is on or that only the MOSFET 126 is on. This corresponds in the example described here to recharging of the capacitor 117 above a voltage of the order of approximately 280V.

The current source 121 is preferably a voltage-controlled current source, wherein the control voltage can be implemented by means of the (rectified) system voltage (dashed line 116 in FIG. 1). This ensures that the current through the light-emitting diodes or for charging the capacitor is also (virtually) sinusoidal (or near-sinusoidal owing to the rectified pulsating signal in the form of a sinusoidal half-wave) and therefore does not disrupt or does not significantly disrupt the power supply system.

The diodes 112, 114 and 120 can be implemented as electronic switches, for example as transistors, MOSFETs, etc. In particular, the electronic switches can be integrated together with the current source 115 and/or the current source 121.

Owing to the fact that the capacitor 117 "pumps" charge into the light-emitting diodes when the rectified system voltage falls below a predetermined threshold, intensity modulation of the light-emitting means is effected at a frequency which is above twice the system frequency. Thus, noticeable flicker of the light-emitting diodes is effectively prevented.

The capacitor 117 is a charge pump in the circuitry proposed in FIG. 1: the capacitor 117 (after initial charging) is charged depending on the voltage of an input signal for a specific period of time; if the voltage falls below a predetermined level, the capacitor pumps charge into the light-emitting means. Discharging and charging can alternate cyclically, wherein a cycle can be predetermined by a near-sinusoidal half-wave of a rectified AC voltage.

An explanation is given below by way of example in respect of the fact that a plurality of charge pumps can also be provided for operation of the light-emitting means.

Figure 2:
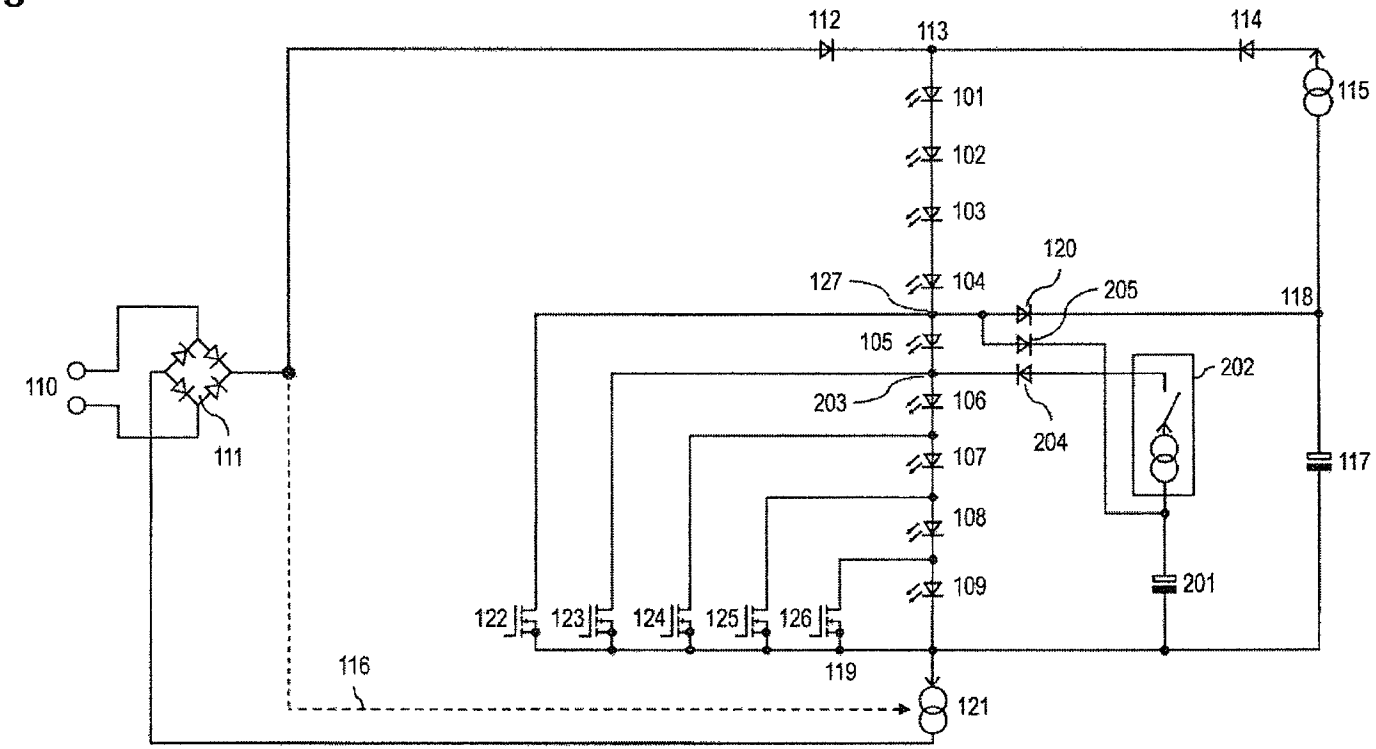
FIG. 2 shows a schematic circuit diagram with two charge pumps for operating a plurality of light-emitting diodes connected in series on an AC system voltage on the basis of the illustration in FIG. 1.

FIG. 2 shows a schematic circuit diagram for operating a plurality of light-emitting diodes 101 to 109 connected in series on an AC system voltage 110 on the basis of the illustration shown in FIG. 1.

In addition to the charge pump shown in FIG. 1, comprising the capacitor with current source 115 and associated circuitry, FIG. 2 has a further charge pump. As a result, the interval times can be shortened further and a brightness impression which once again appears to be continuous can be achieved.

In contrast to FIG. 1, FIG. 2 has a capacitor 201 (for example an electrolyte capacitor), which is connected in series with a current source 202 and a diode 204, wherein the cathode of the diode 204 is connected to a node 203, which corresponds to the tap between the light-emitting diode 105 and the light-emitting diode 106. The capacitor 201 is connected with its negative terminal to the node 119. A tap between the capacitor 201 and the current source 202 is connected to the node 127 via a diode 205, wherein the anode of the diode 205 points in the direction of the node 127.

The diodes 204, 205 are, for example, the same types as the diodes 112, 114 and 120 (1N4004).

The current source 202 can be a current source which can be switched on and off, in particular a controlled current source.

Similarly to the above statements in respect of FIG. 1, the capacitor 201 is charged via the voltage at the node 127 and the diode 205. If the voltage at the node 203 is below a predetermined voltage which is lower than the voltage of the charged capacitor 201, the current source 202 can be switched on and the capacitor 201 feeds energy via the diode 204 into the node 203 and thus supplies energy to the light-emitting diodes 106 to 109. The charge current for the capacitor 201 is limited by the (voltage-controlled) current source 121 and the current through the light-emitting diodes 106 to 109 is also limited by the (possibly voltage-controlled or constant) current source 202.

Optionally, the current source 202 can be dispensed with and can be replaced by an electronic switch, which can be actuated by the control unit. For example, with the activation of the MOSFET 122 (charge flows from the capacitor 117 into the light-emitting diodes 101 to 104 and via the MOSFET 122 into the node 119) this electronic switch can also be activated: then additionally charge flows from the capacitor 201 via the node 203 through the light-emitting diodes 106 to 109 (all MOSFETs 123 to 126 are off). It is also possible for the current source 202 which can be switched on and off (or for the switch provided instead) and for the MOSFET 122 to be operated alternately (with the same or different switch-on and/or switch-off durations).

The supply of power to the light-emitting diodes 106 to 109 can therefore take place by the capacitor 201 in addition to the supply of power to the light-emitting diodes 101 to 104 by the capacitor 117 (see statements above).

FIG. 3 shows a schematic circuit arrangement with a control unit 302 for actuating electronic switches (for example the gate connections of the MOSFETs 122 to 126 shown in FIG. 1 and FIG. 2).

The light-emitting means 305 are, for example, semiconductor light-emitting elements or groups of semiconductor light-emitting elements which are connected in series with one another. In particular, groups of light-emitting means can each be actuated jointly.

A pulsating DC voltage 301 with twice the frequency of an AC system voltage is supplied to a control unit 302. The control unit can have a processor and/or a (micro)controller, which actuates the electronic switches 303 depending on the profile of the pulsating DC voltage 301. The switches 303 can correspond to the MOSFETs shown in FIG. 1 and FIG. 2. In addition, it is possible for the current sources 115 and/or 202 to also be switched on and off (see in this regard the switch in the current source 202 in FIG. 2). In principle, it is possible for other electronic switches, for example (bipolar) transistors, to also be used.

The control unit 302 evaluates the profile of a half-wave of the pulsating DC voltage 301 by virtue of one or more of the switches 303 being actuated depending on the level of the voltage of the half-wave, with the result that the light-emitting means 305 are activated via the switches 303 stepwise in a manner matched to the voltage profile (in this case the number of activated light-emitting means 305 can be increased stepwise corresponding to the level of the voltage profile). For this purpose, the half-wave is preferably divided into steps or switching thresholds, with the result that, as the voltage increases, the light-emitting means 305 are switched on stepwise and, as the voltage of the half-wave falls, the light-emitting means 305 are switched off again stepwise.

Furthermore, the pulsating DC voltage 301 is also supplied to a voltage-controlled current source 304 (cf.: voltage-controlled current source 121 in FIG. 1 and FIG. 2), with this pulsating DC voltage being used to provide a current through the light-emitting mans 305 depending on the voltage of the half-wave (in particular limited). It is thus possible to achieve the situation in which the current through the light-emitting means 305 is also substantially in phase with the system voltage, which has a favorable effect on the power factor and reduces or prevents disruptive influences of the circuit on the power supply system.

The control unit 302 also shows (at least) one energy store 306, which, as described here, functions as a charge pump and "pumps" charge into the light-emitting means depending on the level of the pulsating DC voltage.

The energy store 306 is in this case illustrated by way of example as part of the control unit, but can also be implemented separately thereto. Optionally, in this case the control unit can actuate at least one switch for activating the energy store.

Alternatively, it is possible for the control unit 302 to actuate the voltage-controlled current source 304.

Further Advantages

The at least one charge pump is charged during the light-emitting phase of the light-emitting means; during the time in which the system energy is not available or is insufficient for operation of the light-emitting means, energy is provided for operating the light-emitting means by the at least one charge pump. The energy storage can be performed, for example, by means of a capacitor or by means of another energy store.

This solution also has the advantage that the power factor is substantially dependent on the voltage-controlled current source and is also limited thereby. This results in a substantially sinusoidal current loading of the power supply system.

The charge pump can be implemented discretely or in integrated form.

In particular, the charge pump can be part of the chain of light-emitting means (for example integrated in an LED chain). Embodiments in which the charge voltage of the at least one charge pump is higher than the discharge voltage thereof are advantageous; in particular it is advantageous if, during cyclic charging of the charge pump, more current is provided than during cyclic discharging of the charge pump. Correspondingly (alternatively or in addition), the cyclic charging of the charge pump can also last for longer than the cyclic discharging of said charge pump.

The invention claimed is:

1. A circuit for actuating a plurality of light-emitting means which are connected in series, comprising a plurality of electronic switches, which can be actuated depending on a rectified system voltage, wherein the plurality of electronic switches are arranged in parallel with at least some of the light-emitting means, wherein each of the plurality of electronic switches short-circuits on activation of in each case at least one of the light-emitting means connected in series, with at least one energy store, which is connected in parallel with a first group of light-emitting means during a charge phase by virtue of the electronic switches, and which is connected in parallel with a second group of light-emitting means during a discharge phase by virtue of the electronic switches.

2. The circuit as claimed in claim 1, wherein there is a higher voltage drop across the first group of light-emitting means than across the second group of light-emitting means.

3. The circuit as claimed in claim 1, wherein the energy store is configured to be charged during an initial charge phase over a plurality of cycles of the rectified system voltage.

4. The circuit as claimed in claim 1, wherein the energy store is connected in series with a current source.

5. The circuit as claimed in claim 1, wherein the light-emitting means connected in series are connected in series with a voltage-controlled current source.

6. The circuit as claimed in claim 5, wherein the voltage-controlled current source is actuable via the rectified system voltage.

7. The circuit as claimed in claim 5, wherein the electronic switches and the voltage-controlled current source are arranged together in an integrated circuit.

8. The circuit as claimed in claim 1, comprising a first energy store and a second energy store, wherein the first energy store is connected in parallel with the first group of light-emitting means during a charge phase by virtue of the electronic switches, and is connected in parallel with the second group of light-emitting means during a discharge phase by virtue of the electronic switches, wherein the second energy store is connected in parallel with the first group of light-emitting means during a charge phase by virtue of the electronic switches, and is connected in parallel with a third group of light-emitting means during a discharge phase, wherein the third group of light-emitting means is in particular a subset of the first group of light-emitting means.

9. The circuit as claimed in claim 1, wherein detection and evaluation of the rectified system voltage is performed using a control unit and, depending on a level of the detected system voltage, more or fewer light-emitting means can be activated via the electronic switches.

10. The circuit as claimed in claim 9, wherein dimmable actuation of the light-emitting means is performed using the control unit.

11. The circuit as claimed in claim 9, wherein the control unit and the electronic switches are integrated together in a circuit.

12. The circuit as claimed in claim 1, wherein the light-emitting means comprises at least one semiconductor light-emitting element.

13. The circuit as claimed in claim 1, wherein the electronic switches comprise semiconductor switches.

14. The circuit as claimed in claim 1, wherein the energy store comprises a capacitor, an electrolyte capacitor or a battery.

15. The circuit as claimed in claim 1, wherein the energy store is connected in series with a constant current source or a voltage-controlled current source.

16. The circuit as claimed in claim 1, wherein the light-emitting means comprises a group of semiconductor light-emitting elements.

17. The circuit as claimed in claim 1, wherein the electronic switches comprise bipolar transistors and/or MOSFETs.

* * * * *